United States Patent [19]

Murphy

[11] 3,964,810

[45] June 22, 1976

[54] MODULAR SHELF AND CABINET SYSTEM

[76] Inventor: Thomas V. Murphy, P.O. Box 156, Oradell, N.J. 07649

[22] Filed: May 15, 1975

[21] Appl. No.: 577,901

[52] U.S. Cl. ..... 312/257 R; 312/111; 211/188; 108/144

[51] Int. Cl.[2] ..... A47B 13/02

[58] Field of Search ..... 211/148, 135, 176, 177, 211/182, 108; 312/111, 257 SK; 108/111, 144, 153, 315; 403/349

[56] References Cited

UNITED STATES PATENTS

| | | | |
|---|---|---|---|
| 3,053,558 | 9/1962 | Challas, Jr. et al. | 312/111 UX |
| 3,170,742 | 2/1965 | Berkowitz | 312/108 |
| 3,545,625 | 12/1970 | MacMillan | 211/148 |
| 3,664,274 | 5/1972 | Bustos | 108/144 |

*Primary Examiner*—Casmir A. Nunberg
*Attorney, Agent, or Firm*—Mandeville and Schweitzer

[57] ABSTRACT

The invention relates to a shelf and cabinet system of modular construction, arranged such that, with a few standard components, display shelving, storage cabinets and the like, may be assembled quickly and easily and in a wide variety of configurations. The systems includes, as a significant feature, a preformed structural shelf, which includes aligned sockets and lugs for securing legs and spacer columns. The pre-formed shelving unit includes integral marginal tracks or grooves arranged to receive cabinet panels. In a typical unit of rectangular shape, dual tracks are provided along the longer sides, to accommodate sliding door panels, if desired. The cross sectional configuration of the sockets and lugs is such as to receive vertically grooved spacer columns, which are arranged for alignment with the panel receiving grooves in the shelf units. The vertical grooves provide a decorative effect and also serve a functional purpose when cabinet panels are utilized in the assembly.

To advantage, the pre-formed shelf units are injection molded of a material such as medium impact polystyrene. The spacer columns desirably are extruded of similar material.

13 Claims, 12 Drawing Figures

MODULAR SHELF AND CABINET SYSTEM

BACKGROUND AND SUMMARY OF THE INVENTION

In connection with the display of merchandise, for example, it is advantageous for a store manager to be able to quickly set up and dismantle special display arrangements for different kinds of merchandise and for special events, etc. Modular assembly systems for this purpose are, of course, generally well known, and a number of such systems are available commercially. The system of the present invention, however, represents a significant improvement over what has been heretofore known and available, in terms of overall low cost, lightweight construction, ease of assembly and disassembly, and easy adaptability to a wide variety of structural configurations.

A basic feature of the invention resides in the structure and configuration of an injection molded shelf unit, which is designed to provide a high strength-to-weight relationship and which includes integral structural features which enable the shelf to be readily incorporated in an overall structural assembly. In part, the molded shelf unit includes an integral, upstanding lug at each corner, projecting upwardly from the surface of the shelf and arranged to be received internally of a hollow spacer column. Directly underneath the upwardly projecting lug, and within the confines of a downwardly extending skirt flange which defines the edges of the shelf, is a downwardly opening socket arranged to receive the upper end of a leg or spacer column. Both the upwardly projecting lug, and the downwardly opening socket are slightly tapered, so that the spacer columns can be tightly assembled therewith to provide a rigid assembly.

To advantage, each injection molded shelf unit is provided with molded-in grooves near the edges, one set of grooves facing upwardly from the upper surface of the shelf and a corresponding set facing downwardly from the lower surface of the shelf. The arrangement is such that cabinet-forming panels, either fixed or sliding, may be received in an opposed set of grooves provided by a pair of vertically spaced shelving units, in order to form a closed-in cabinet structure. Preferably along the long side of the shelf unit, closely spaced double grooves or tracks are provided to accommodate a sliding door assembly. The molded shelf unit is provided with integral skirt flanges around the edges. These, in conjunction with strengthening flanges extending at appropriate locations under the main shelf surface, provide a highly rigid, yet lightweight structural unit which can support substantial weight.

Strong and rigid spacer columns are provided by extruding an element of uniform cross section, the exterior dimensions and configurations of which are such as to cause the element to be tightly received in the downwardly facing socket in the shelf, while the internal dimensions and configurations are such as to cause the element to be tightly received over the upwardly projecting lug. Extruded-in longitudinal recesses in the spacer columns serve not only to add strengh and enhance the appearance of the unit, but also to receive end edges of the cabinet forming panels, when used.

As will be understood upon consideration of the further description, the injection molded shelf and the extruded spacer column, forming the principal modular elements of the system, enable an endless variety of display units to be quickly and easily assembled and disassembled. By way of example, open shelving units may be arranged in single units, or in multiple side by side units. Selective ones or all of the open shelf units may be closed in with side paneling, to form cabinets. For example, it may be desirable to provide one cabinet section for extra merchandise, in conjunction with associated open shelving displays. The system of the invention also accommodates the installation of wire-style or panel-style edge fencing or the like. The arrangement also accommodates the support of open bin type sales displays, sign panel supports and the like, limited only by the ingenuity and imagination of the display manager.

PRIOR ART OF INTEREST

The prior art of interest includes the following United States patents: Challas, Jr. et al U.S. Pat. No. 3,053,558, Gruenberg U.S. Pat. No. 3,507,399, Blowers U.S. Pat. No. 3,529,878, Olaf Von Bohr U.S. Pat. No. 3,549,020, Alster U.S. Pat. No. 3,661,434, Murcia U.S. Pat. No. 3,669,033, Misenheimer, III U.S. Pat. No. 3,730,601, Lang U.S. Pat. No. 3,834,324, Flum et al U.S. Pat. No. 3,853,073 and Silson U.S. Pat. No. 3,861,327. Of the foregoing, the Misenheimer U.S. Pat. No. 3,730,601 is perhaps the most interesting in terms of general concept. The system of the applicant's invention, however, provides for a structural assembly which, while in its general terms, is similar to the structure of the Misenheimer patent, has important advantages in terms of the more specific structural features of the individual components, enabling a highly attractive yet entirely functional assembly to be constructed with simple, inexpensive lightweight molded and extruded plastic elements.

For a more complete understanding of the above and other features and advantages of the invention, reference should be made to the accompanying drawings, and to the following detailed description of selected preferred embodiments.

DESCRIPTION OF PREFERRED EMBODIMENTS OF THE INVENTION

Figure 1:
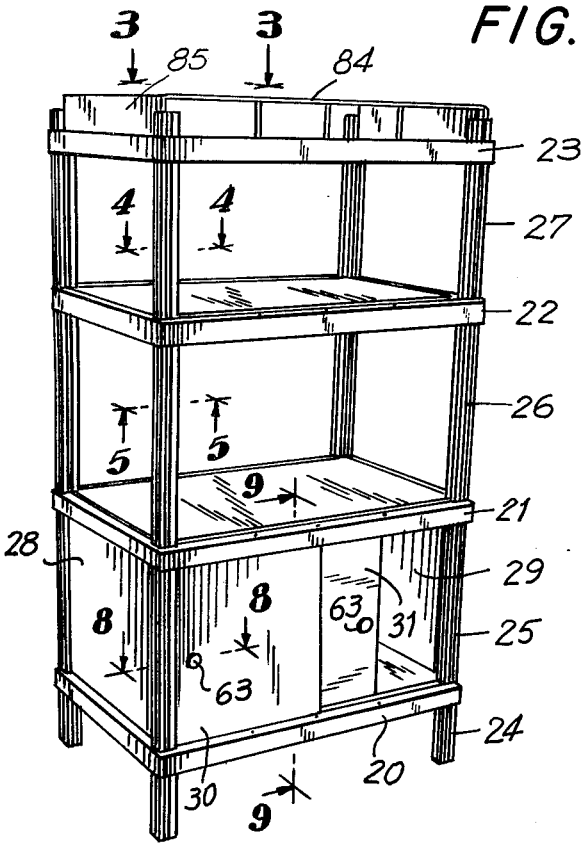
FIG. 1 is a perspective view of a structural shelf assembly constructed in accordance with the invention.

Referring now to the drawings, and initially to FIG. 1 thereof, the reference numerals 20–23 identify individual shelving panels, which are specially constructed in accordance with the invention and will be described further in greater detail. The lower shelving unit 20 is supported above the floor by means of short column-like legs 24, which are detachably assembled to the bottom of the shelving unit. The upper shelving units 21–23 are each spaced above the lower adjacent unit by means of spacer columns 25, 26, 27 respectively, which are detachably secured to the respective shelving units in a manner, hereinafter described in more detail, which results in the entire assembly being in the form of a rigid, unitary structure. By means to be hereinafter described, cabinet-forming panels 28, 29 may be utilized to enclose the open area between selected adjacent shelving units, and some of these panels, the panels 30, 31 in the arrangement illustrated in FIG. 1, may be slideably supported to form doors.

Referring now more particularly to FIGS. 2–9, the various leg and spacer column elements, identified generically by the letter C, are advantageously formed by continuous extrusion of a medium impact polystyrene material and thus will have a uniform cross section throughout. In the specifically illustrated form of the invention, the spacer columns C are of square, hollow cross section and a typical unit for use in displaying merchandise in a store might have a width dimension on the order of one and three quarter inches on a side, and a wall thickness on the order of 100 mils. Neither the specific shape nor the specific dimensions are critical to the invention, however. For purposes to be hereinafter explained more fully, at least some and preferably all of the side walls of the spacer column C are provided with longitudinally extending grooves or recesses 32, which are centrally located in the side walls 33 and face outwardly, forming at the same time inwardly extending ribs 34. To advantage, the spacer columns C may be furnished initially in the form of semicontinuous lengths of the extruded polystyrene, which can be either cut to length at the installation site for custom shelving arrangements, or alternatively furnished to the customer in standard sections of predetermined length for assemblies of popular dimensions.

The various shelving units 20–23 of FIG. 1 are identified generically in FIGS. 2–9 by the letter S. Each of these units is desirably injection molded of a medium impact polystyrene material. While it should be understood that the typical dimensions hereinafter referred to are explanatory only and not critical to the invention, a molded shelf unit according to the invention intended particularly for merchandise display and the like, may have an overall length on the order of 34 inches and a width dimension on the order of say, 22 inches. A unit of these general proportions typically may have a molded wall thickness of around 140 mils in the area of the top wall 40 and also in the area of an integral depending peripheral skirt flange 41, which extends along the front and back edges and also along the end edges. The peripheral flange walls 41 typically may extend downward about two inches from the upper wall 40 of the shelving unit. Underneath, the shelving unit S may have a plurality of integral downwardly depending strengtening ribs, not shown in detail. In a unit of the typical dimensions previously indicated, strengtening ribs of about 1⅜ inches in depth and 110 mils or so in width will be provided at appropriate locations on the lower side of the shelving unit S. A first pair of such flanges 42 may be provided to extend diagonally between the corner areas. A second such pair 43 may be provided extending longitudinally, and a third pair 44 extends transversely. Such a construction has, for example, proven adequate to support safely a load of 300 pounds without undue deflection. As will be readily appreciated, however, a greater or lesser number of strengthening ribs may be provided according to the load requirement of the specific unit.

In accordance with one aspect of the invention, the shelving unit S is provided at each of its four corner areas with an upwardly projecting lug post 45, which is molded integrally with the overall shelf unit S. The lug post 45 has external dimensions and configurations which are substantially those of the inside of the spacer columns C. In addition, however, the lug posts 45 are tapered slightly from bottom to top, typically at an angle of around one fourth degree from the vertical, converging toward the top. The dimensions of the lug post 45 at its upward extremity thus may be slightly less than the internal dimensions of the spacer column C, while the dimensions of the lug post at its bottom may be somewhat greater than those of the spacer column. The arrangement is such that the spacer column may be easily applied over the top of the lug post 45 but, when pressed downward over it, is forced to expand slightly and becomes frictionally locked to the lug.

Figure 2:
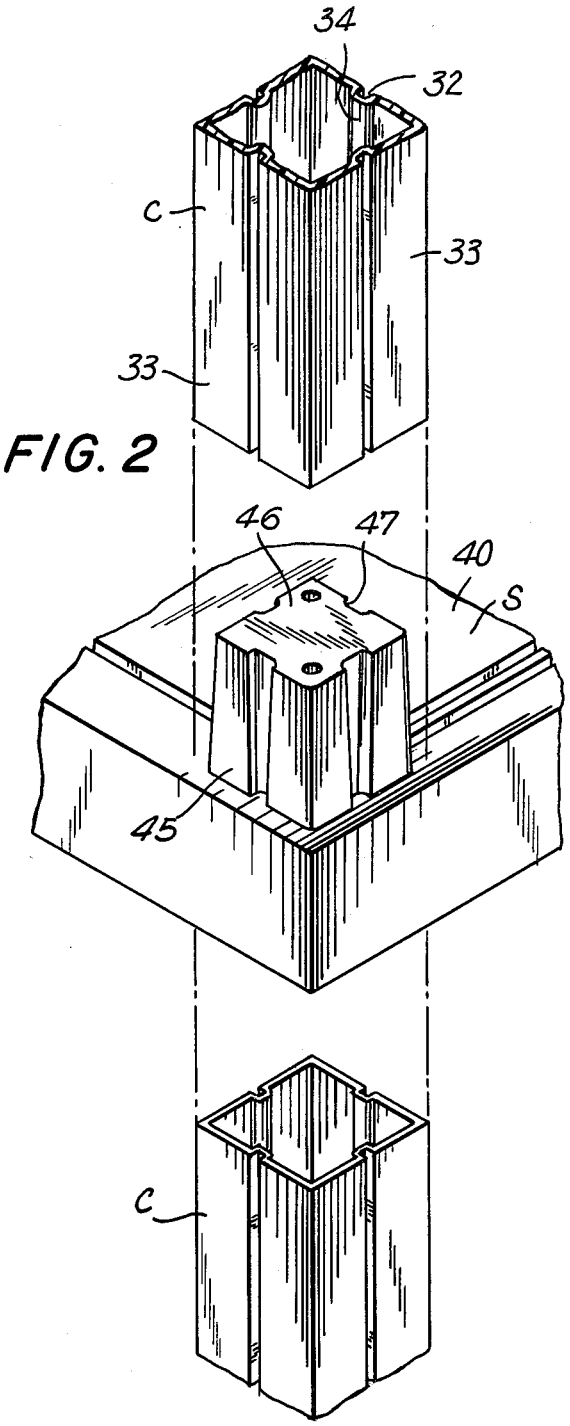
FIG. 2 is a greatly enlarged, exploded, fragmentary view showing details of the corner structure of the modular shelving system of the invention.

As reflected particularly in FIG. 2, a recess 47 is formed in the center of each side wall of the lug post, and extends vertically upward. In general, the dimensions and configurations of the recesses 47 correspond with the dimensions and configurations of the ribs 34 formed on the interior walls of the spacer columns C. Desirably, however, the walls of the recesses 47 taper slightly, diverging in an upward direction, to facilitate the initial reception of the spacer columns while firmly frictionally locking therewith as the spacer column is forced over the lug post into a butting contact with the upper surface 40 of the shelf unit. In an assembly of the typical dimensions heretofore indicated, the lug posts 45 may have an overall height of around two inches, terminating in a flat upper surface 46.

Figure 5:
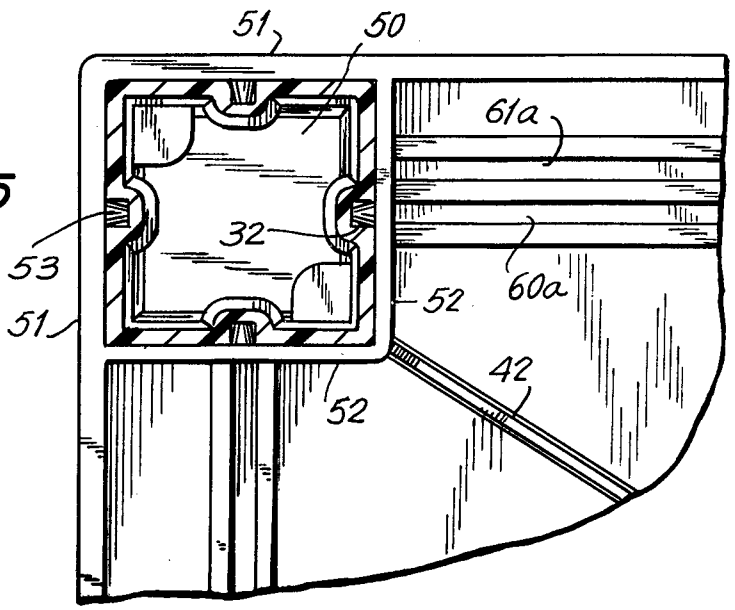
FIGS. 4 and 5 are enlarged, fragmentary cross sectional views taken generally on lines 4—4, 5—5 of FIG. 1.
Figure 4:
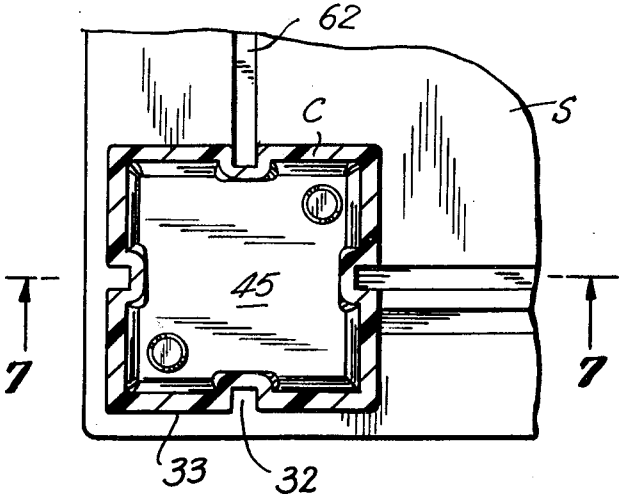
Figure 6:
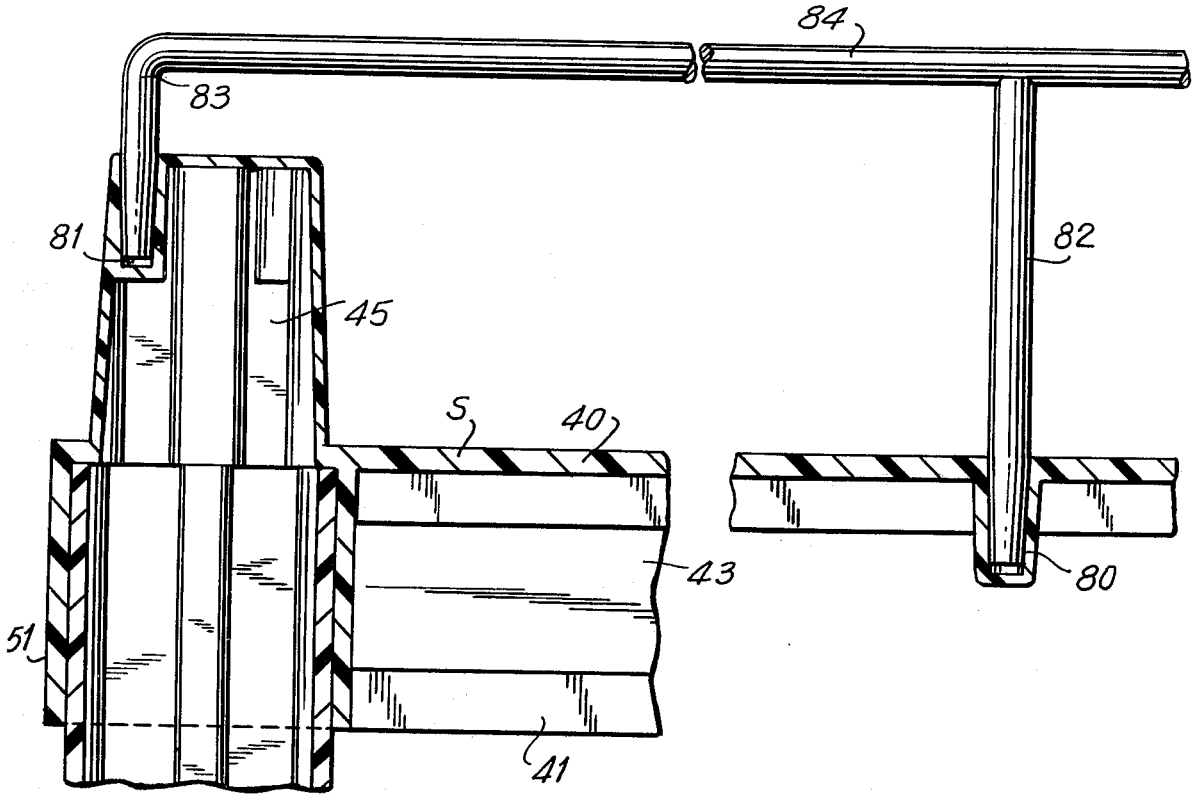
FIGS. 6–9 inclusive are enlarged, fragmentary, cross sectional views taken along lines 6—6 to 9—9 respectively of FIGS. 3, 4 and 1.
Figure 7:
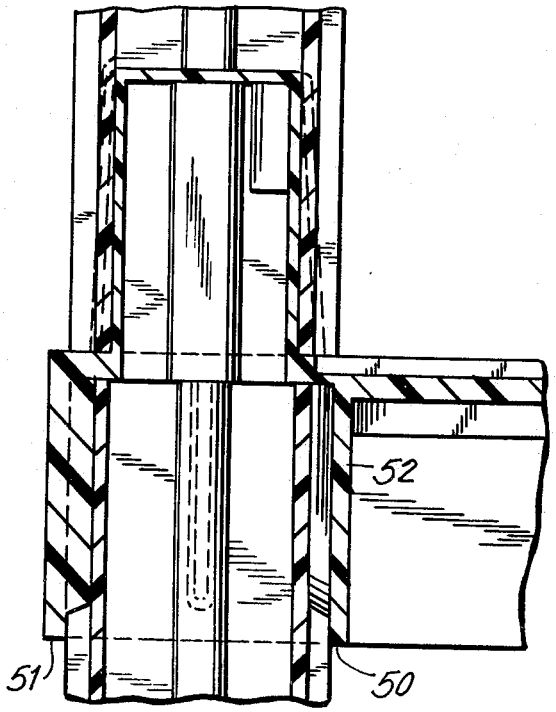

As reflected particularly in FIGS. 5–7, the shelf units S are provided, directly underneath each of the lug posts 45, with a column receiving socket 50, formed in part by corner areas 51 of the marginal flange 41 and in part by integral socket-forming walls 52. The socket 50 has dimensions and interior configurations substantially corresponding to the exterior dimensions and configuration of the spacer columns C, so as to enable the columns to be tightly received within the sockets. In addition, the internal surfaces of the side walls 51, 52 are slightly tapered, diverging downwardly, typically at around one fourth degree from the vertical. Thus, as with the lug post 45, the sockets 50 easily admit the ends of the spacer columns C, yet tightly frictionally grip the columns upon full insertion thereof. Desirably, the sockets 50 are provided on their internal walls with ribs 53 extending vertically and arranged to be received mostly within the longititudinal recesses 32 of the spacer columns. The ribs 53 impart additional strength to the spacer column-to-shelf assembly, but may be omitted in specific situations if the additional strength is not needed.

In the construction of a display shelf assembly, such as illustrated in FIG. 1, a length of the extruded support column section is cut to form legs 24 and spacer columns 25–27. The leg elements 24 are inserted into the sockets 50 of the lower most shelf unit 20, to establish the lower most shelf level, and the subsequent shelving units 21–23 are added to the assembly by first applying spacer columns over the upstanding lug posts 45 of successive shelving units, with each set of spacer columns being received in the downwardly facing sockets 50 of the next successive shelf. Because of the slightly tapered configuration of the sockets 50 and lugs 45, in conjunction with spacer columns of uniform cross section, a strong, rigid frictional assembly is provided between the columns and shelving units, as will be appreciated.

In accordance with one aspect of the invention, the shelving units S are provided with molded-in marginal tracks or grooves extending parallel to each edge, spaced somewhat inwardly from the edge extremity. Along the front and back edges, the upper surface is provided with tracks 60, 61, one of which (60) is lined up with the vertical recess 47 of the lug posts 45. Along the side edges of the upper surface, the tracks 62 are also arranged in alignment with the lug recesses 47. As reflected particularly in FIGS. 5 and 9, the underside of the shelving units is provided with similar marginal tracks 60*a*–62*a*, corresponding in location and alignment to the just described tracks 60–62.

In order to convert a pair of spaced shelving units to an enclosed cabinet arrangement, as reflected in the lower part of FIG. 1, side panels 28, 29 are inserted in the tracks 62, 62*a* of a pair of vertically adjacent shelves. In the back portion of the shelf assembly, a single panel (not specifically illustrated) may be inserted in the tracks 60, 60*a*, to form a solid back to the cabinet structure. In the front wall (and also in the back wall if desired) door panels 30, 31 are inserted in the respective grooves 60, 61 and 60*a*, 61*a*. The panels 30, 31 are significantly shorter in length than are the tracks 60, 61, and are arranged to be freely slideable therein, thus forming a sliding door closure. Knobs 63 may be provided for convenience in manipulating the door panels.

Figure 8:
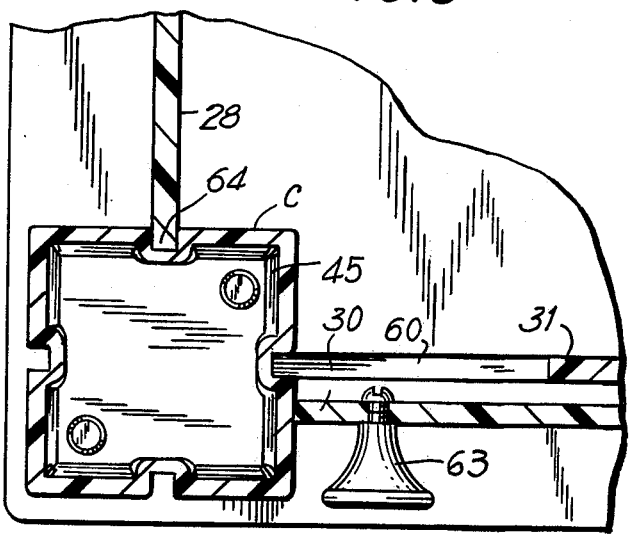
Figure 9:
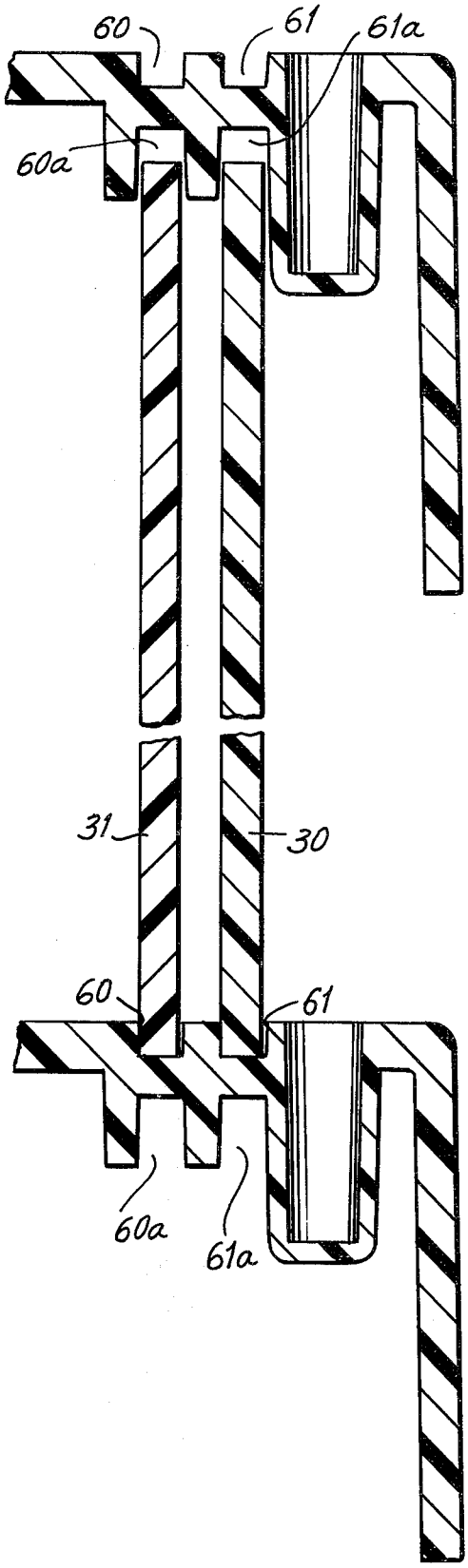

As reflected in FIG. 8, when a spacer column C is in assembled relation to a lug post 45, one of the vertical grooves or recesses 32 in the outer walls of the spacer column is lined up with the shelf tracks 60 or 62. Thus, when the cabinet panels are assembled into the structure, the end extremities 64 are received in the column grooves, so that the fixed panels may be supported along all four edges.

Figure 12:
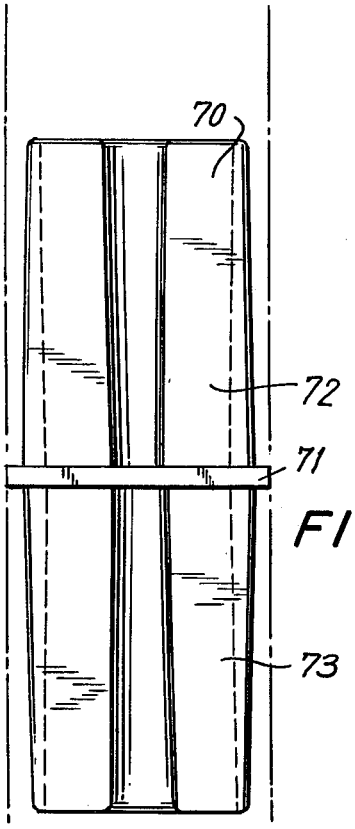
FIG. 12 is an elevational view of a column connecting unit which may be utilized in conjunction with any of the shelving assemblies constructed in accordance with the invention.

In some cases, it may be necessary or desirable to connect spacer column sections end to end without the interposition of intervening shelf section. For this purpose, a connector unit 70 (FIG. 12), may be employed. The connector element has a central transverse flange 71, the external dimensions of which approximate the external dimensions of the spacer column. Extending longitudinally in both directions from the flange 70 are lug sections 72, 73. These lug sections are, in general, similar in shape and dimensions to the lug posts 45, which are formed integrally with the shelf sections. The connector 70 may be assembled together with a pair of spacer column sections and serves to form a relatively rigid, extended column structure.

Figure 3:
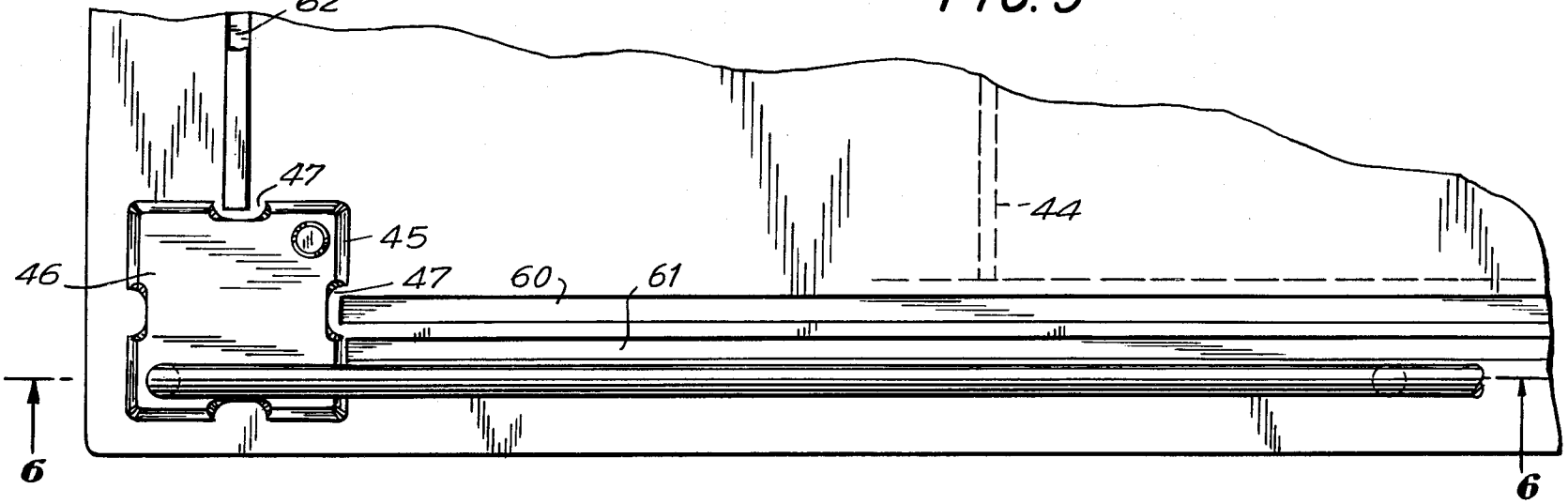
FIG. 3 is an enlarged, fragmentary top plan view of the assembly shown in FIG. 1.

As shown for example in FIGS. 1, 3 and 6, the side margins of the shelving units S may be provided at appropriate locations with molded-in sockets 80, including one or more sockets 81 located in the lug posts 45. These sockets, which are slightly tapered, converging toward the bottom, are arranged to receive snugly the downwardly extending posts 82, 83 of a section of wire-style edge fencing 84. The arrangement specifically illustrated in FIGS. 3 and 6 is, of course, suitable for the upper most shelving unit, in which the lug post 45 is exposed. For use in connection with lower shelving units, the end most fence support 83 may be omitted, and the fencing section terminated adjacent the post.

As an alternative to the wire-style edge fencing, or for use in conjunction therewith, if desired, a short panel section 85 may be arranged to be received along its lower edge in one of the shelving tracks 60, 62 and along a portion of its end edges in the vertical recesses 47 in the edge posts at the end of such tracks.

Figure 10:
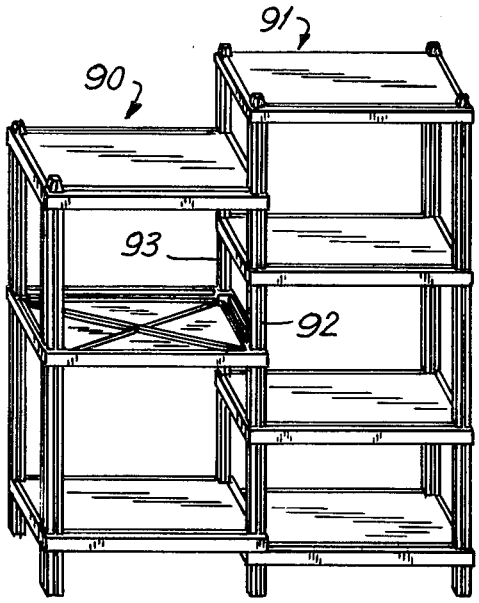
FIGS. 10 and 11 are perspective views of modified shelving assemblies constructed in accordance with the invention.
Figure 11:
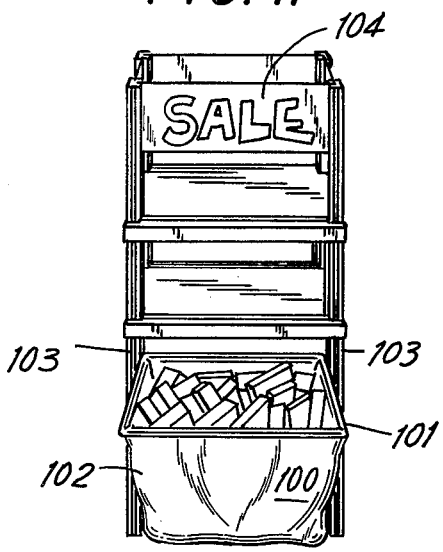

As reflected in FIGS. 1, 10 and 11, the system of the present invention is adaptable to a wide variety of display shelving and other structures. In the assembly of FIG. 1, it is evident that the shelf spacing may be readily varied, and that any one or more of the spaces between adjacent shelves may be closed off by paneling to form cabinets. In addition, edge fencing may be easily installed, where desired.

In the arrangement of FIG. 10, a pair of shelf assemblies 90, 91 are arranged in a side by side relationship, with a common central column structure 92, 93 forming part of each unit. With this arrangement, the shelf panels of one unit are arranged in vertically staggered relation to the shelving panels of the other unit. This permits the shelves to be slightly overlapped, accommodating the use of a single, common central column structure.

In the arrangement of FIG. 11, shelf panels have been omitted in the lower portion of the structure, and a display bin 100 has been installed in that area. The bin 100, which may be of conventional construction, typically includes an upper frame section 101 and a bag 102 supported thereby. The frame 101 may be bolted or otherwise secured to the column sections 103 forming the lower leg sections of the shelf structure. The structure of FIG. 11 also includes an illustration of a sign panel 104, which is received by its edge margins in the vertical recesses 32 in the spacer columns.

As will be apparent, the system of the present invention provides an extremely versatile and flexible arrangement for the assembly of modular display units and similar structures. The heart of the system is, of course, the particular molded shelving panel, which may be of ample strength, yet of lightweight construction, and includes integral, molded-in lug posts and sockets for the reception of spacer columns and legs. By forming the lug posts and sockets with a slight taper, for association with extruded spacer columns of uniform cross section, it is possible to provide an assembled unit of strong, rigid construction which may be assembled without bolts or other fasteners.

One of the advantageous features of the system of the invention involves the integral formation in the molded shelf unit of edge tracks, which are generally aligned with the lug posts and sockets. These edge tracks receive, either slideably or in a fixed manner, cabinet forming panels. The arrangement is such that a pair of vertically adjacent shelves, in conjunction with a plurality of panels and in conjunction with the related spacer columns, form an attractive closed cabinet.

With a single, standard shelf unit constructed in accordance with the invention, it is possible to assemble almost any combination of shelving, with and without cabinet sections, with and without edge fencing of various styles and, where appropriate, providing means for the support of display signs and the like. The components of the system are lightweight, simple, inexpensive, easily handled and stored. The variety of structures which may be formed with the components of the invention is virtually limitless. In addition, the shelf panels can be stacked in a nested fashion for convenient shipment and storage.

It will be appreciated by those skilled in the art that the basic principles of the invention may be applied in a wide variety of specific rays to suit a variety of needs and objectives. Thus, within practical limits, an assembly may be produced in almost any size or shape. For example, attractive mini-sized display assemblies, suitable for jewelry and similar articles, may be made in an attractive and advantageous form utilizing materials such as clear polystyrene, for example. Particularly in the smaller sizes, where the shelving units do not require rib reinforcing, the shelves may be used in an inverted orientation to form trays. In such cases, the lug post may serve as short legs of the tray, or spacer columns may be connected to the lugs to form extended legs. When inverted, the peripheral flanges form edge fences for the trays (see FIG. 10).

It will also be appreciated that, where desirable or appropriate, the shelving units may be formed with opposed pairs of lug posts or opposed pairs of sockets at the column-receiving locations. The arrangement illustrated herein, in which each column-receiving location includes a lug post and a corresponding socket is convenient for most applications and has certain advantages in terms of efficiencies in production and storage, but the alternate forms are clearly within the contemplation of the invention.

It should thus be understood that the specific forms of the invention herein illustrated and described are intended to be representative only, as certain changes may be made therein without departing from the clear teachings of the disclosure. Accordingly, reference should be made to the following appended claims in determining the full scope of the invention.

I claim:

1. In a modular structural system for the assembly of display shelving and the like and of the type including separable shelf panels and spacer columns, the improvement characterized by a. said spacer columns being formed of extruded sections and being of relatively uniform hollow cross section throughout, b. said shelf panels being of molded plastic construction and including generally flat panel sections and integral, downwardly extending peripheral flanges along all sides, c. said shelf panels having, at a plurality of spaced points, integral, upwardly extending lug posts, d. said lug posts being of such dimensions and of such cross sectional configuration as to be tightly received within the hollow interior of said spacer columns, e. said shelf panels further having integral, downwardly opening sockets at a plurality of spaced points, and f. said sockets being of such dimensions and of such cross sectional configuration as to tightly receive an end portion of a spacer column.

2. A modular structural system according to claim 1, further characterized by a. said lug posts and said sockets being aligned one directly above the other in said shelf panels.

3. A modular structural system according to claim 1, further characterized by a. said lug posts being slightly tapered in a direction to converge toward their free ends, b. said sockets being tapered in a direction to diverge slightly toward their open ends, and c. the dimensional relationships of the lug posts, sockets and spacer columns being such that, upon assembly of spacer columns to the lug posts and sockets, the spacer columns are slightly expanded by the lug posts and slightly compressed by the sockets to provide a tight, friction fitting assembly.

4. A modular structural system according to claim 1, further characterized by a. said shelf panels being generally retangular in configuration, b. said lug posts and sockets being located generally in the corner areas of said shelf panel, and c. said sockets being formed in part by said peripheral flange.

5. A modular structural system according to claim 4, further characterized by a. said shelf panel having integral, molded-in edge grooves, extending along the upper and lower panel surfaces, between respective pairs of lug posts and respective pairs of sockets, and b. panel sections receivable in said edge grooves and adapted to be supported by vertically adjacent pairs of shelf panels.

6. A modular structural system according to claim 5, further characterized by a. said spacer columns having extruded grooves extending throughout their length, b. said extruded grooves being substantially aligned with at least certain of the edge grooves in said shelf panels, whereby a panel supported along its top and bottom edges in said edge grooves may be supported along its end edges in the extruded grooves in said spacer column.

7. In a modular structural system for the assembly of display shelving and the like, the combination of a. an injection molded shelving panel, including a generally flat panel section and an integral, downwardly extending peripheral flange, b. said panel being of generally flat-sided, polygonal configuration, c. a column-receiving socket formed integrally with said panel, one at each corner area, d. a column-engaging lug post formed integrally with said panel, one above each socket, e. a plurality of extruded spacer column sections adapted for tight-fitting frictional engagement with said lug posts and sockets, f. said lug posts and sockets being of sufficient axial length to align and support said spacer columns when telescopically engaged therewith, and g. said lug posts and sockets being tapered in directions to tightly grip said spacer columns upon full telescropic assembly thereof.

8. A modular structural system according to claim 7, further characterized by a. said lug posts, sockets and spacer columns being generally of square cross section.

9. The modular structural system of claim 7, further characterized by a. elongated panel receiving grooves being formed integrally in the upper and lower surfaces of said shelf panels and axially in said spacer columns, b. said panel receiving grooves being aligned in oppositely facing pairs in an assembly comprising a pair of spaced shelving panels supported by a plurality of spacer columns, and c. wall-forming panel means engaged by said opposed pairs of panel receiving grooves to form cabinet walls.

10. A modular structural system according to claim 7, further characterized by a. connector means for engaging spacer column sections in end-to-end arrangement, and b. said connector means including a pair of lug post members arranged in back-to-back relation.

11. In a modular structural system for the assembly of display shelving and the like, the combination of a. an injection molded shelving panel, including a generally flat panel section and an integral, downwardly extending peripheral flange, b. said panel being of generally flat-sided polygonal configuration, c. a column-receiving socket formed integrally with said panel, one at each corner area, d. a column-engaging lug post formed integrally with said panel, one above each socket, e. a plurality of extruded spacer column sections adapted for tight-fitting frictional engagement with said lug posts and sockets, f. said lug posts and sockets being of sufficient axial length to align and support said spacer columns when telescopically engaged therewith, g. said lug posts and sockets being tapered in directions to tightly grip said spacer column upon full telescopic assembly thereof, h. elongated panel receiving grooves being formed integrally in the upper and lower surfaces of said shelf panels and axially in said spacer columns, i. a set of double parallel panel receiving grooves along at least one edge of said shelf panels, and j. wall-forming panel means engaged by said opposed pairs of panel receiving grooves to form cabinet walls, including a pair of panel members slidably received in said double grooves to form sliding cabinet doors.

12. In a modular structural system for the assembly of display shelving and the like, the combination of a. an injection molded shelving panel including a generally flat panel section and an integral, downwardly extending peripheral flange, b. said panel being invertible to form a tray, c. said panel being of generally flat-sided polygonal configuration, d. a column-receiving socket formed integrally with said panel, one at each corner area, e. a column-engaging lug post formed integrally with said panel, one above each socket, f. a plurality of extruded spacer column sections adapted for tight-fitting frictional engagement with said lug posts and sockets, g. said lug posts and sockets being of sufficient axial length to align and support said spacer columns when telescopically engaged therewith, h. said lug posts and sockets being tapered in directions to tightly grip said spacer column upon full telescopic assembly thereof.

13. A modular structural system according to claim 12, further characterized by a. the system comprising a plurality of shelving panels including one or more arranged in inverted orientation and one or more arranged in upright orientation.

* * * * *